US007435866B2

(12) United States Patent
Ishiyama et al.

(10) Patent No.: US 7,435,866 B2
(45) Date of Patent: Oct. 14, 2008

(54) METHOD FOR NEUTRALIZING SOLID RESIDUE IN ABANDONED CHEMICAL WEAPONS

(75) Inventors: Keiichi Ishiyama, Kobe (JP); Kiyoshi Asahina, Kobe (JP)

(73) Assignee: Kabushiki Kaisha Jobe Seiko Sho, Hyogo (JP)

( * ) Notice: Subject to any disclaimer, the term of this patent is extended or adjusted under 35 U.S.C. 154(b) by 507 days.

(21) Appl. No.: 10/234,145

(22) Filed: Sep. 5, 2002

(65) Prior Publication Data

US 2003/0050525 A1 Mar. 13, 2003

(30) Foreign Application Priority Data

Sep. 7, 2001 (JP) ..... 2001-272066

(51) Int. Cl.
*A62D 3/00* (2007.01)

(52) U.S. Cl. ..... 588/401; 588/405

(58) Field of Classification Search ..... 588/299, 588/401, 400, 405
See application file for complete search history.

(56) References Cited

U.S. PATENT DOCUMENTS

| | | | | |
|---|---|---|---|---|
| 3,810,788 | A * | 5/1974 | Steyermark | 134/42 |
| 3,810,842 | A | 5/1974 | Steyermark et al. | |
| 4,656,159 | A * | 4/1987 | McPherson et al. | 514/25 |
| 6,121,506 | A * | 9/2000 | Abel et al. | 588/318 |

FOREIGN PATENT DOCUMENTS

| | | |
|---|---|---|
| DE | DD 299 457 A7 | 2/1980 |
| DE | 31 02746 A1 | 1/1981 |
| FR | 2 766 724 A1 | 7/1997 |
| WO | WO 00/15306 | 9/1998 |

OTHER PUBLICATIONS

European Search Report dated Jun. 3, 2004.

* cited by examiner

*Primary Examiner*—Edward M Johnson
(74) *Attorney, Agent, or Firm*—Reed Smith LLP; Stanley P. Fisher, Esq.; Juan Carlos A. Marquez, Esq.

(57) ABSTRACT

A method for decontaminating and neutralizing solid residue remaining in a munition shell of an abandoned chemical weapon includes the steps of dissolving the solid residue using an organic solvent to obtain a solid residue solution, and neutralizing the solid residue solution with an alkaline solution and an oxidant.

12 Claims, 2 Drawing Sheets

METHOD FOR NEUTRALIZING SOLID RESIDUE IN ABANDONED CHEMICAL WEAPONS

BACKGROUND OF THE INVENTION

1. Field of the Invention

The present invention relates to a method for neutralizing and decontaminating solid residue adhered onto munition bodies of abandoned chemical weapons.

2. Description of the Related Art

Chemical weapons or chemical munitions using highly toxic chemical agents such as mustard and lewisite have been known for some time. A recent discovery has revealed that substantial amounts of unprocessed chemical weapons are still left buried underground or dumped in lakes or sea in certain regions. This fact poses a serious threat to human lives and has become a major social concern. The decontamination of these chemical weapons is thus an urgent task.

Chemical munitions have generally been processed according to the following steps:

(1) fixing a chemical munition recovered from underground or the like, boring the munition bodies using a disassembling machine or the like, inserting a nozzle into the bore, and feeding an alkaline solution, e.g., a NaOH solution, at normal temperature from the nozzle so that the alkaline solution can circulate therein to wash away and hydrolyze liquid chemical agents;

(2) mechanically separating a burster from the munition shell by cutting, and destroying the burster by a separate explosive destruction process;

(3) fixing the munition shell to the disassembling machine for the second time, allowing an alkaline solution, e.g., a NaOH solution, at a high temperature to circulate to dissolve the solid residue (hereinafter also referred to as "heel") remaining in the munition shell until chemical agents are eliminated, and hydrolyzing the solid residue; and (4) discharging the circulated solution into a reaction vessel, allowing the circulated solution to react with an oxidant at a high temperature, so as to oxidize the intermediate products resulting from decomposition of the chemical agents into stable salts.

However, the surface of the heel remaining in the munition shell has an insoluble coat resulting from high-polymeric modification of chemical agents due to long-term abandonment. Thus, the heel cannot be sufficiently dissolved even with a strong alkaline solution at a high temperature, thereby inhibiting hydrolysis. One possible solution is to cut the insoluble coat of the heel or the heel itself into minute pieces in advance; however, such cutting requires high precision and complicated steps, resulting in a longer processing time and inefficiency, which is a problem.

SUMMARY OF THE INVENTION

The present invention aims to solve the problems and overcome weaknesses encountered in the conventional art. It is an object of the present invention to provide a method for neutralizing solid residue, i.e., heel, in a chemical weapon that can reliably and completely dissolve the solid residue to promote hydrolysis and that can efficiently decontaminate the chemical weapon in a short time.

A first aspect of the present invention provides a method for decontaminating and neutralizing solid residue remaining in a munition shell of an abandoned chemical weapon, including the steps of: dissolving the solid residue using an organic solvent to obtain a solid residue solution; and neutralizing the solid residue solution with an alkaline solution and an oxidant.

Preferably, in the step of neutralizing the solid residue solution, hydrolysis with the alkaline solution is performed first, and oxidation with the oxidant is performed next.

Preferably, in the step of neutralizing the solid residue solution, hydrolysis with the alkaline solution and oxidation with the oxidant are performed simultaneously.

A second aspect of the present invention provides a method for decontaminating and neutralizing solid residue remaining in a munition shell of an abandoned chemical weapon, including the steps of: dissolving the solid residue with a mixture containing an organic solvent and an alkaline solution to obtain a solid residue solution; and neutralizing the solid residue solution with an alkaline solution and an oxidant.

A third aspect of the present invention provides a method for decontaminating and neutralizing solid residue remaining in a munition shell of an abandoned chemical weapon, including the steps of dissolving the solid residue with an organic solvent so as to perform a primary dissolving process, treating the solid residue remaining in the munition shell with a mixture of the organic solvent and an alkaline solution to perform a secondary dissolving process and a primary hydrolysis process to obtain a solid residue solution, and neutralizing the solid residue solution with an oxidant. Preferably, an alkaline solution is added to the solid residue solution.

Preferably, the organic solvent used in the step of dissolving the solid residue comprises at least one selected from the group consisting of methyl isobutyl ketone, N,N-dimethylformamide, and dimethyl sulfoxide.

Preferably, the alkaline solution is a NaOH solution or a KOH solution. Preferably, the oxidant contains $H_2O_2$.

DESCRIPTION OF THE PREFERRED EMBODIMENTS

The embodiments and the advantages of the present invention will now be described in detail.

In order to ascertain an effective washing-dissolving solution having a heel dissolving property superior to that of a conventional alkaline solution, the present inventors have obtained real samples of heel and have conducted dissolution experiments using various types of washing-dissolving solution. As a result, the inventors have found that organic solvents can satisfactorily dissolve the heel and the modified high polymeric coat formed on the surface of the heel.

Based on the information about the physical property of the heel, the present inventors anticipated that ketones or amides may be particularly effective among organic solvents since they have a polarity between that of aqueous and oily. Representative examples of such organic solvents are methyl isobutyl ketone (MIBK), N,N-dimethylformamide (DMF), and dimethyl sulfoxide (DMSO). Using these examples, dissolution experiments were conducted on various types of heel. These three organic solvents exhibited particularly high heel dissolving properties, as described below, even with a highly insoluble heel sample that remained undissolved after hydrolysis with an NaOH solution, and the heel samples were thoroughly dispersed in these organic solvents.

Solubility of a Highly Insoluble Heel Sample after Hydrolysis

| | |
|---|---|
| MIBK: | 5.8 g/mL |
| DMF: | 4.3 g/mL |
| DMSO: | 3.6 g/mL |

Based on these results, experiments combining dissolution, hydrolysis, and oxidation processes were conducted using the above-described organic solvents, a NaOH solution, and an oxidant to approximate the actual neutralization process. The following was found as a result of the experiments:

(1) the solid residue can be effectively dissolved with these organic solvents; and (2) a process that suitably combines a step of dissolving the heel using these organic solvents, a step of hydrolysis using an alkaline solution, and a step of oxidation using an oxidant can relatively easily neutralize the solid residue in a short time, which had previously been impossible using known techniques.

The present invention has been accomplished based on the results of the above experiments. The present invention will now be described with reference to the drawings in terms of two typical embodiments of preferred processes of the present invention.

First Embodiment

Figure 1:
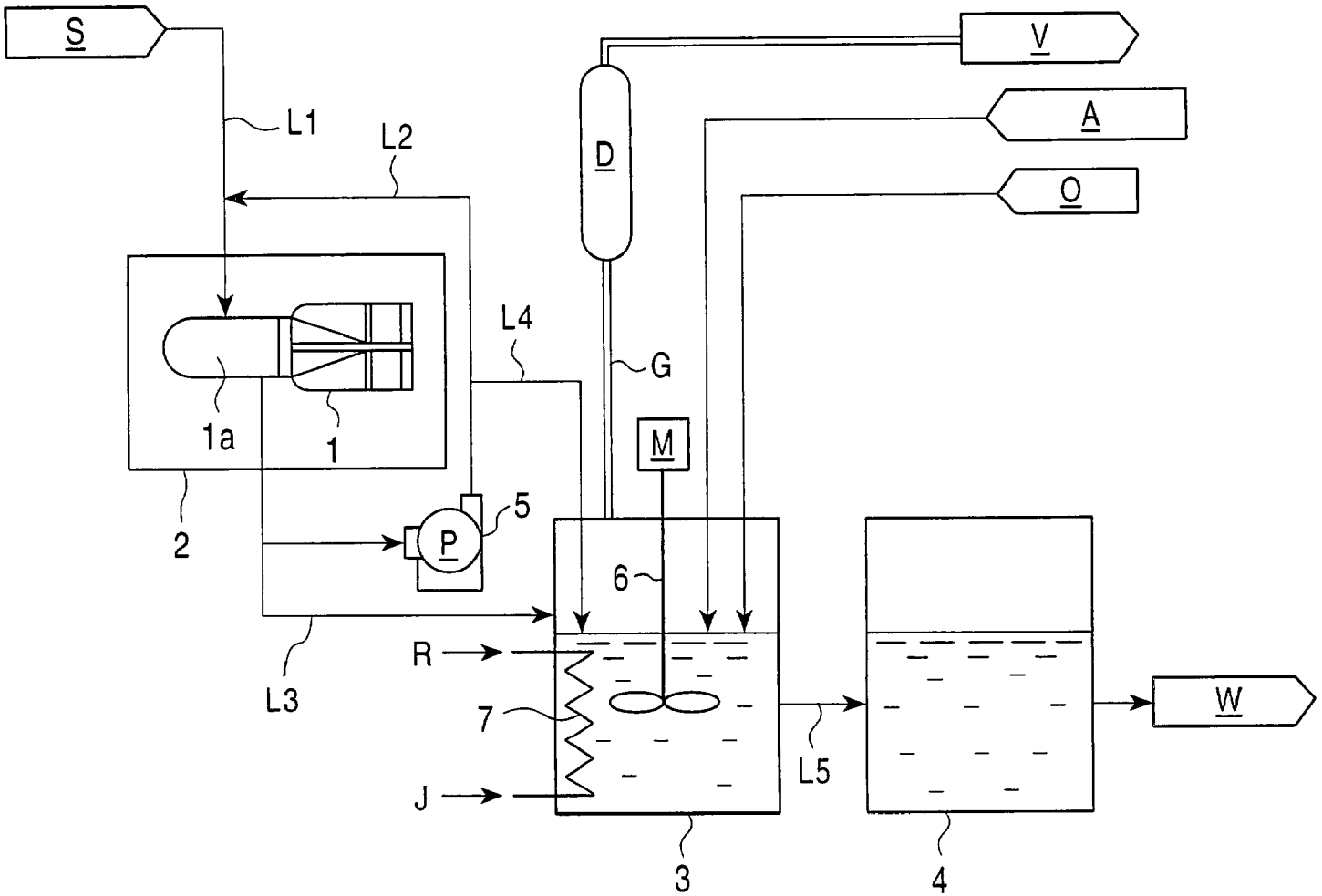
FIG. 1 is a process chart illustrating a first embodiment of the present invention.

FIG. 1 is a process chart illustrating a first embodiment of the present invention. In FIG. 1, reference numeral 1 denotes a chemical munition, 2 denotes a disassembling machine for demolishing the chemical munition 1 installed inside a disassembling chamber, 3 denotes a reaction vessel for hydrolyzing and oxidizing a solution in which heel, i.e., solid residue, is dissolved, hereinafter referred to as the solid residue solution or heel solution, and 4 denotes a processed solution storage vessel for storing the solution that has been subjected to the above processes.

First, the chemical munition 1 is fixed, and a hole is bored in a munition shell 1*a* using the disassembling machine 2. A nozzle is inserted into the hole. After a burster is mechanically separated from the munition shell 1*a* by cutting, an organic solvent S such as MIBK or the like is fed from the nozzle via a solvent supply line L1 and is circulated by a pump 5 through a solvent circulation line L2 to wash the munition shell 1*a* and dissolve the heel remaining in the munition shell 1*a*. The washing and dissolving by the organic solvent S is performed at normal temperature. When the heel is completely dissolved and removed from the munition shell, the supply and circulation of the organic solvent S are stopped. The circulated liquid, i.e., the heel solution, is discharged via a heel solution discharging line L3 into the reaction vessel 3. A line L4 is a circulation adjusting line for adjusting the circulation rate of the organic solvent S. The excess solvent is discharged into the reaction vessel 3 via the line L4.

Next, while the heel solution in the reaction vessel 3 is stirred with an impeller 6, an alkaline solution A such as NaOH or KOH, and an oxidant such as hydrogen peroxide ($H_2O_2$) are simultaneously added to the heel solution so as to hydrolyze and oxidize the heel solution simultaneously. Meanwhile, hot steam J is fed to a heat exchanger 7 to maintain the temperature of the heel solution at 110 to 115° C., i.e., at a boiling temperature.

When the above-described hydrolysis and oxidation are completed, cooling water R is fed to the heat exchanger 7 to cool the reacted solution to normal temperature. The reacted solution, i.e., the processed solution, is discharged to the processed solution storage vessel 4 via a processed solution discharge line L5. After the amount of the processed solution stored in the processed solution storage vessel 4 reaches a predetermined level, the processed solution is subjected to decontamination such as stabilization according to its components such as arsenic or the like, is sealed in a steel drum, and is stored as a waste solution W.

The effluent gas from the reaction vessel 3 is discharged via an effluent gas line G and a condenser D. The effluent gas, i.e., a vessel vent V, is then subjected a separate decontamination.

According to this embodiment, the munition shell is washed and the heel is dissolved with an organic solvent such as MIBK or the like. Thus, even a highly insoluble heel which is difficult to dissolve with a NaOH solution can be dissolved and removed in a short time. Moreover, since an alkaline solution and an oxidant are simultaneously added to the heel solution in the reaction vessel to perform simultaneous hydrolysis and oxidation thereof, neutralization can be performed efficiently in a short time. Furthermore, since the process is performed at a boiling temperature of 110 to 115° C., the reaction rate can be further increased. The reaction rate of hydrolysis at a boiling temperature is 6 times or more higher than that at a low temperature, i.e., 90° C. or less. Since the organic solvent can be recycled, the process in this embodiment is economically advantageous as well.

Although the hydrolysis and oxidation are simultaneously performed in this embodiment, the present invention is not limited to this embodiment. The oxidation may be performed after hydrolysis, as has been performed conventionally. Moreover, the present invention includes a modification in which the process is performed at a temperature of 90° C. or more and less than 110° C., which is the boiling temperature.

Second Embodiment

Figure 2:
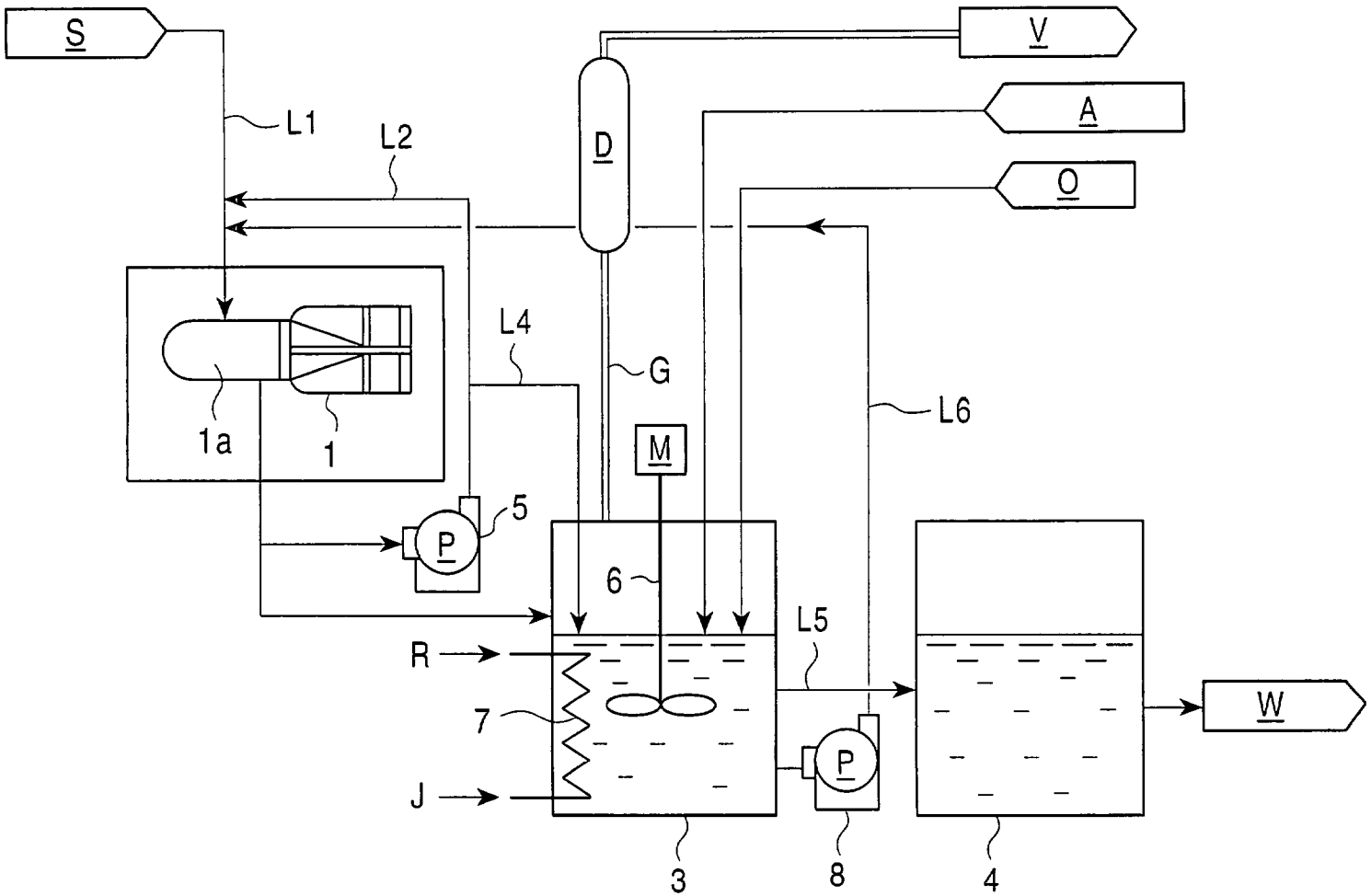
FIG. 2 is a process chart illustrating a second embodiment of the present invention.

A second embodiment of the process of the present invention will now be described. FIG. 2 is a process chart illustrating the second embodiment of the present invention. In the following description of the second embodiment, the detailed descriptions of the components and the steps common to the first embodiment are omitted. Only those differing from the first embodiment are described in detail.

As in the first embodiment, a hole is bored in the munition shell 1*a* of the chemical munition 1, and a nozzle is inserted into the hole. The organic solvent S such as MIBK or the like described above is fed via the solvent supply line L1 and is circulated using the pump 5 via the solvent circulation line L2 so as to dissolve the heel remaining in the munition shell 1*a* (a primary dissolving process).

Next, after a specific amount of the heel has been dissolved and removed by the primary dissolving process described above, the supply and the circulation of the organic solvent S are halted, and the circulated liquid, i.e., the heel solution, is discharged into the reaction vessel 3 via the heel solution discharge line L3.

While the heel solution in the reaction vessel 3 is being stirred with the impeller 6, an alkaline solution A such as NaOH, KOH, or the like is added to the heel solution.

Subsequently, the liquid in the reaction vessel 3, i.e., the mixture of the organic solvent and the alkaline solution, is discharged using a pump 8. The mixture is circulated via a mixture circulation line L6 so as to dissolve any heel still remaining in the munition shell (a secondary dissolving process) until the heel is completely dissolved and removed and to simultaneously perform partial hydrolysis (a primary hydrolysis process).

An oxidant O is added to the heel solution in the vessel after the above-described treatment. The alkaline solution A may be further added to the solution if necessary. A secondary hydrolysis treatment and oxidation are performed at a boiling temperature of 110 to 115° C. so as to complete the neutralization.

According to this embodiment, a primary dissolving process using an organic solvent such as MIBK and a secondary dissolving process for the mixture of organic solvent and the alkaline solution are performed in combination in two stages. Thus, heel can be completely dissolved and removed in a short time even when applied to a chemical munition in which a large amount of heel remains or even when a thick insoluble coat is formed at the surface of the heel. Moreover, since the process using both the organic solvent and the alkaline solution can significantly promote dissolution and hydrolysis of the heel, the workload imposed on the secondary hydrolysis can be significantly decreased, thereby improving the efficiency of the overall process. Since the organic solvent used in the primary dissolving process and the mixture used in the secondary dissolving process can be recycled, the process has an economical advantage.

In this embodiment, the mixture used in the secondary dissolving and in the hydrolysis contains an organic solvent and an alkaline solution. Alternatively, an oxidant may be added to the mixture. When the oxidant is added to the mixture, partial oxidation can also be performed during the process. In this embodiment, the alkaline solution in the mixture is recycled from the reaction vessel; alternatively, a mixture of a fresh organic solvent and a fresh alkaline solution may be circulated without having to pass through the reaction vessel.

As described above, according to the neutralization process of the present invention, the solid residue, i.e., the heel, remaining in chemical weapons can be completely dissolved in a short time while sufficiently promoting the hydrolysis. Thus, decontamination of chemical weapons as a whole can be efficiently performed in a short time. The present invention provides an important technical contribution to this field.

What is claimed is:

1. A method for decontaminating and neutralizing solid residue remaining in a munition shell of an abandoned chemical weapon, comprising the steps of:

dissolving the solid residue using an organic solvent to obtain a solid residue solution, as a first step; and neutralizing the solid residue solution with an alkaline solution and an oxidant, as a second step, wherein the solid residue is a result of polymeric modification of a chemical agent in a munition shell of an abandoned chemical weapon, and wherein the organic solvent used in the step of dissolving the solid residue comprises at least one selected from the group consisting of methyl isobutyl ketone, and N,N-dimethylformamide.

2. The method according to claim 1, wherein, in the step of neutralizing the solid residue solution, hydrolysis with the alkaline solution is performed, and oxidation with the oxidant is then performed.

3. The method according to claim 1, wherein, in the step of neutralizing the solid residue solution, hydrolysis with the alkaline solution and oxidation with the oxidant are performed simultaneously.

4. A method for decontaminating and neutralizing solid residue remaining in a munition shell of an abandoned chemical weapon, comprising the steps of:

dissolving the solid residue with a mixture comprising an organic solvent and an alkaline solution to obtain a solid residue solution, as a first step; and neutralizing the solid residue solution with an alkaline solution and an oxidant, as a second step, wherein the solid residue is a result of polymeric modification of a chemical agent in a munition shell of an abandoned chemical weapon, and wherein the organic solvent used in the step of dissolving the solid residue comprises at least one selected from the group consisting of methyl isobutyl ketone and N,N-dimethylformamide.

5. A method for decontaminating and neutralizing solid residue remaining in a munition shell of an abandoned chemical weapon, comprising the steps of:

dissolving the solid residue with an organic solvent so as to perform a primary dissolving process, as a first step;

treating the solid residue remaining in the munition shell with a mixture of the organic solvent and an alkaline solution to perform a secondary dissolving process and a primary hydrolysis process to obtain a solid residue solution, as a second step; and neutralizing the solid residue solution with an oxidant, as a third step, wherein the solid residue is a result of polymeric modification of a chemical agent in a munition shell of an abandoned chemical weapon, and wherein the organic solvent used in the step of dissolving the solid residue comprises at least one selected from the group consisting of methyl isobutyl ketone and N,N-dimethylformamide.

6. The method according to claim 1, wherein the alkaline solution is a NaOH solution or a KOH solution.

7. The method according to claim 1, wherein the oxidant comprises $H_2O_2$.

8. The method according to claim 5, wherein, in the step of neutralizing the solid residue solution, an alkaline solution is added to the solid residue solution.

9. The method according to claim 5, wherein the alkaline solution is a NaOH solution or a KOH solution.

10. The method according to claim 5, wherein the oxidant comprises $H_2O_2$.

11. The method according to claim 4, wherein the alkaline solution is a NaOH solution or a KOH solution.

12. The method according to claim 4, wherein the oxidant comprises $H_2O_2$.

* * * * *

UNITED STATES PATENT AND TRADEMARK OFFICE

CERTIFICATE OF CORRECTION

PATENT NO. : 7,435,866 B2
APPLICATION NO. : 10/234145
DATED : October 14, 2008
INVENTOR(S) : Ishiyama et al.

It is certified that error appears in the above-identified patent and that said Letters Patent is hereby corrected as shown below:

On the Title Page, Under Item (73) please delete:

"Kabushiki Kaisha Jobe Seiko Sho"

and insert:

--Kabushiki Kaisha Kobe Seiko Sho--

Signed and Sealed this

Second Day of December, 2008

JON W. DUDAS
*Director of the United States Patent and Trademark Office*